US007668325B2

(12) United States Patent
Puria et al.

(10) Patent No.: US 7,668,325 B2
(45) **Date of Patent: *Feb. 23, 2010**

(54) HEARING SYSTEM HAVING AN OPEN CHAMBER FOR HOUSING COMPONENTS AND REDUCING THE OCCLUSION EFFECT

(75) Inventors: Sunil Puria, Sunnyvale, CA (US); Rodney C. Perkins, Woodside, CA (US)

(73) Assignee: EarLens Corporation, Palo Alto, CA (US)

( * ) Notice: Subject to any disclaimer, the term of this patent is extended or adjusted under 35 U.S.C. 154(b) by 453 days.

This patent is subject to a terminal disclaimer.

(21) Appl. No.: 11/121,517

(22) Filed: May 3, 2005

(65) Prior Publication Data

US 2006/0251278 A1 Nov. 9, 2006

(51) Int. Cl.
*H04R 25/00* (2006.01)

(52) U.S. Cl. ..... 381/322; 381/328; 181/135

(58) Field of Classification Search ..... 381/320, 381/326, 328, 322; 181/135
See application file for complete search history.

(56) References Cited

U.S. PATENT DOCUMENTS

| | | | |
|---|---|---|---|
| 3,440,314 | A | 4/1969 | Frisch |
| 3,549,818 | A | 12/1970 | Turner et al. |
| 3,585,416 | A | 6/1971 | Mellen |
| 3,594,514 | A | 7/1971 | Wingrove |
| 3,710,399 | A | 1/1973 | Hurst |
| 3,712,962 | A | 1/1973 | Epley |
| 3,764,748 | A | 10/1973 | Branch et al. |
| 3,808,179 | A | 4/1974 | Gaylord |
| 3,882,285 | A | 5/1975 | Nunley et al. |
| 3,985,977 | A | 10/1976 | Beaty et al. |
| 4,002,897 | A | 1/1977 | Kleinman et al. |
| 4,061,972 | A | 12/1977 | Burgess |
| 4,075,042 | A | 2/1978 | Das |
| 4,098,277 | A | 7/1978 | Mendell |
| 4,109,116 | A | 8/1978 | Victoreen |
| 4,120,570 | A | 10/1978 | Gaylord |

(Continued)

FOREIGN PATENT DOCUMENTS

| | | |
|---|---|---|
| AU | 2004-301961 | 2/2005 |

(Continued)

OTHER PUBLICATIONS

Best, V. et al., "The influence of high frequencies on speech localization," *Abstract 981* (Feb. 24, 2003) from <www.aro.org/abstracts/abstracts.html>.

(Continued)

*Primary Examiner*—Curtis Kuntz
*Assistant Examiner*—Jesse A Elbin
(74) *Attorney, Agent, or Firm*—Townsend and Townsend and Crew LLP

(57) ABSTRACT

A hearing system comprises a shell having an open inner chamber. An input transducer and a transmitter assembly are disposed in the open inner chamber. The transmitter has a frequency response bandwidth in a 6 kHz to 20 kHz range, and the open chamber has an end adjacent a patient's tympanic membrane with one or more openings that allow the ambient sound to pass through the chamber and directly reach the middle ear of the user.

24 Claims, 7 Drawing Sheets

U.S. PATENT DOCUMENTS

| | | | | |
|---|---|---|---|---|
| 4,248,899 | A | 2/1981 | Lyon et al. | |
| 4,252,440 | A | 2/1981 | Frosch et al. | |
| 4,303,772 | A | 12/1981 | Novicky | |
| 4,319,359 | A | 3/1982 | Wolf | |
| 4,334,315 | A | 6/1982 | Ono et al. | |
| 4,334,321 | A | 6/1982 | Edelman | |
| 4,357,497 | A | 11/1982 | Hochmair et al. | |
| 4,380,689 | A | 4/1983 | Giannetti | |
| 4,428,377 | A | 1/1984 | Zollner et al. | |
| 4,524,294 | A | 6/1985 | Brody | |
| 4,540,761 | A | 9/1985 | Kawamura et al. | |
| 4,556,122 | A | 12/1985 | Goode | |
| 4,592,087 | A * | 5/1986 | Killion | 381/328 |
| 4,606,329 | A | 8/1986 | Hough | |
| 4,611,598 | A | 9/1986 | Hortmann et al. | |
| 4,628,907 | A | 12/1986 | Epley | |
| 4,641,377 | A | 2/1987 | Rush et al. | |
| 4,689,819 | A | 8/1987 | Killion | |
| 4,696,287 | A | 9/1987 | Hortmann et al. | |
| 4,729,366 | A | 3/1988 | Schaefer | |
| 4,741,339 | A | 5/1988 | Harrison et al. | |
| 4,742,499 | A | 5/1988 | Butler | |
| 4,756,312 | A | 7/1988 | Epley | |
| 4,766,607 | A | 8/1988 | Feldman | |
| 4,774,933 | A | 10/1988 | Hough et al. | |
| 4,776,322 | A | 10/1988 | Hough et al. | |
| 4,800,884 | A | 1/1989 | Heide et al. | |
| 4,817,607 | A | 4/1989 | Tatge | |
| 4,840,178 | A | 6/1989 | Heide et al. | |
| 4,845,755 | A | 7/1989 | Busch et al. | |
| 4,932,405 | A | 6/1990 | Peeters et al. | |
| 4,936,305 | A | 6/1990 | Ashtiani et al. | |
| 4,944,301 | A | 7/1990 | Widin et al. | |
| 4,948,855 | A | 8/1990 | Novicky | |
| 4,957,478 | A | 9/1990 | Maniglia | |
| 4,999,819 | A | 3/1991 | Newnham et al. | |
| 5,003,608 | A | 3/1991 | Carlson | |
| 5,012,520 | A | 4/1991 | Steeger | |
| 5,015,224 | A | 5/1991 | Mariglia | |
| 5,015,225 | A | 5/1991 | Hough et al. | |
| 5,031,219 | A | 7/1991 | Ward et al. | |
| 5,061,282 | A | 10/1991 | Jacobs | |
| 5,066,091 | A | 11/1991 | Stoy et al. | |
| 5,094,108 | A | 3/1992 | Kim et al. | |
| 5,117,461 | A | 5/1992 | Moseley | |
| 5,142,186 | A | 8/1992 | Cross et al. | |
| 5,163,957 | A | 11/1992 | Sade et al. | |
| 5,167,235 | A | 12/1992 | Seacord et al. | |
| 5,201,007 | A | 4/1993 | Ward et al. | |
| 5,259,032 | A | 11/1993 | Perkins et al. | |
| 5,272,757 | A | 12/1993 | Scofield et al. | |
| 5,276,910 | A | 1/1994 | Buchele | |
| 5,277,694 | A | 1/1994 | Leysieffer et al. | |
| 5,360,388 | A | 11/1994 | Spindel et al. | |
| 5,378,933 | A | 1/1995 | Pfannenmueller et al. | |
| 5,402,496 | A | 3/1995 | Soli et al. | |
| 5,411,467 | A | 5/1995 | Hortmann et al. | |
| 5,425,104 | A | 6/1995 | Shennib | |
| 5,440,082 | A | 8/1995 | Claes | |
| 5,440,237 | A | 8/1995 | Brown et al. | |
| 5,455,994 | A | 10/1995 | Termeer et al. | |
| 5,456,654 | A | 10/1995 | Ball | |
| 5,531,787 | A | 7/1996 | Lesinski et al. | |
| 5,531,954 | A | 7/1996 | Heide et al. | |
| 5,535,282 | A * | 7/1996 | Luca | 381/328 |
| 5,554,096 | A | 9/1996 | Ball | |
| 5,558,618 | A | 9/1996 | Maniglia | |
| 5,606,621 | A | 2/1997 | Reiter et al. | |
| 5,624,376 | A | 4/1997 | Ball et al. | |
| 5,707,338 | A | 1/1998 | Adams et al. | |
| 5,721,783 | A | 2/1998 | Anderson | |
| 5,729,077 | A | 3/1998 | Newnham et al. | |
| 5,740,258 | A | 4/1998 | Goodwin-Johansson | |
| 5,762,583 | A | 6/1998 | Adams et al. | |
| 5,772,575 | A | 6/1998 | Lesinski et al. | |
| 5,774,259 | A | 6/1998 | Saitoh et al. | |
| 5,782,744 | A | 7/1998 | Money | |
| 5,788,711 | A | 8/1998 | Lehner et al. | |
| 5,795,287 | A | 8/1998 | Ball et al. | |
| 5,797,834 | A | 8/1998 | Goode | |
| 5,800,336 | A | 9/1998 | Ball et al. | |
| 5,804,109 | A | 9/1998 | Perkins | |
| 5,804,907 | A | 9/1998 | Park et al. | |
| 5,814,095 | A | 9/1998 | Muller et al. | |
| 5,825,122 | A | 10/1998 | Givargizov et al. | |
| 5,836,863 | A | 11/1998 | Bushek et al. | |
| 5,842,967 | A | 12/1998 | Kroll | |
| 5,857,958 | A | 1/1999 | Ball et al. | |
| 5,859,916 | A | 1/1999 | Ball et al. | |
| 5,879,283 | A | 3/1999 | Adams et al. | |
| 5,888,187 | A | 3/1999 | Jaeger et al. | |
| 5,897,486 | A | 4/1999 | Ball et al. | |
| 5,899,847 | A | 5/1999 | Adams et al. | |
| 5,900,274 | A | 5/1999 | Chatterjee et al. | |
| 5,906,635 | A | 5/1999 | Maniglia | |
| 5,913,815 | A | 6/1999 | Ball et al. | |
| 5,940,519 | A | 8/1999 | Kuo | |
| 5,949,895 | A | 9/1999 | Ball et al. | |
| 5,987,146 | A | 11/1999 | Pluvinage et al. | |
| 6,005,955 | A | 12/1999 | Kroll et al. | |
| 6,024,717 | A | 2/2000 | Ball et al. | |
| 6,045,528 | A | 4/2000 | Arenberg et al. | |
| 6,050,933 | A | 4/2000 | Bushek et al. | |
| 6,068,589 | A | 5/2000 | Neukermans | |
| 6,068,590 | A | 5/2000 | Brisken | |
| 6,084,975 | A | 7/2000 | Perkins et al. | |
| 6,093,144 | A | 7/2000 | Jaeger et al. | |
| 6,137,889 | A * | 10/2000 | Shennib et al. | 381/328 |
| 6,139,488 | A | 10/2000 | Ball | |
| 6,153,966 | A | 11/2000 | Neukermans | |
| 6,174,278 | B1 | 1/2001 | Jaeger et al. | |
| 6,181,801 | B1 | 1/2001 | Puthuff et al. | |
| 6,190,305 | B1 | 2/2001 | Ball et al. | |
| 6,190,306 | B1 | 2/2001 | Kennedy | |
| 6,208,445 | B1 | 3/2001 | Reime | |
| 6,217,508 | B1 | 4/2001 | Ball et al. | |
| 6,222,302 | B1 | 4/2001 | Imada et al. | |
| 6,222,927 | B1 | 4/2001 | Feng et al. | |
| 6,240,192 | B1 | 5/2001 | Brennan et al. | |
| 6,241,767 | B1 | 6/2001 | Stennert et al. | |
| 6,261,224 | B1 | 7/2001 | Adams et al. | |
| 6,277,148 | B1 | 8/2001 | Dormer | |
| 6,312,959 | B1 | 11/2001 | Datskos | |
| 6,339,648 | B1 | 1/2002 | McIntosh et al. | |
| 6,354,990 | B1 | 3/2002 | Juneau et al. | |
| 6,366,863 | B1 | 4/2002 | Bye et al. | |
| 6,385,363 | B1 | 5/2002 | Rajic et al. | |
| 6,387,039 | B1 | 5/2002 | Moses | |
| 6,393,130 | B1 | 5/2002 | Stonikas et al. | |
| 6,422,991 | B1 | 7/2002 | Jaeger | |
| 6,432,248 | B1 | 8/2002 | Popp et al. | |
| 6,436,028 | B1 | 8/2002 | Dormer | |
| 6,438,244 | B1 | 8/2002 | Juneau et al. | |
| 6,445,799 | B1 | 9/2002 | Taenzer et al. | |
| 6,473,512 | B1 | 10/2002 | Juneau et al. | |
| 6,475,134 | B1 | 11/2002 | Ball et al. | |
| 6,493,454 | B1 | 12/2002 | Loi et al. | |
| 6,519,376 | B2 | 2/2003 | Biagi et al. | |
| 6,536,530 | B2 | 3/2003 | Schultz et al. | |
| 6,537,200 | B2 | 3/2003 | Leysieffer et al. | |
| 6,549,633 | B1 | 4/2003 | Westermann | |
| 6,554,761 | B1 | 4/2003 | Puria et al. | |
| 6,575,894 | B2 | 6/2003 | Leysieffer et al. | |
| 6,592,513 | B1 | 7/2003 | Kroll et al. | |

| | | | | |
|---|---|---|---|---|
| 6,603,860 | B1 | 8/2003 | Taezner et al. | |
| 6,620,110 | B2 | 9/2003 | Schmid | |
| 6,626,822 | B1 | 9/2003 | Jaeger et al. | |
| 6,629,922 | B1 | 10/2003 | Puria et al. | |
| 6,668,062 | B1 | 12/2003 | Luo et al. | |
| 6,676,592 | B2 | 1/2004 | Ball et al. | |
| 6,695,943 | B2 | 2/2004 | Juneau et al. | |
| 6,724,902 | B1 | 4/2004 | Shennib et al. | |
| 6,728,024 | B2 | 4/2004 | Ribak | |
| 6,735,318 | B2 | 5/2004 | Cho | |
| 6,754,358 | B1 | 6/2004 | Boeson et al. | |
| 6,801,629 | B2 | 10/2004 | Brimhall et al. | |
| 6,829,363 | B2 | 12/2004 | Sacha | |
| 6,842,647 | B1 | 1/2005 | Griffith et al. | |
| 6,888,949 | B1 | 5/2005 | Vanden Berghe et al. | |
| 6,900,926 | B2 | 5/2005 | Ribak | |
| 6,912,289 | B2 | 6/2005 | Vonlanthen et al. | |
| 6,920,340 | B2 | 7/2005 | Laderman | |
| 6,940,989 | B1 | 9/2005 | Shennib et al. | |
| D512,979 | S | 12/2005 | Corcoran et al. | |
| 6,978,159 | B2 | 12/2005 | Feng et al. | |
| 7,043,037 | B2 | 5/2006 | Lichtblau | |
| 7,072,475 | B1 | 7/2006 | DeNap et al. | |
| 7,076,076 | B2 | 7/2006 | Bauman | |
| 7,095,981 | B1 | 8/2006 | Voroba et al. | |
| 7,167,572 | B1 | 1/2007 | Harrison et al. | |
| 7,174,026 | B2 | 2/2007 | Niederdrank | |
| 7,203,331 | B2 | 4/2007 | Boesen | |
| 7,239,069 | B2 | 7/2007 | Cho | |
| 7,245,732 | B2 | 7/2007 | Jorgensen et al. | |
| 7,289,639 | B2 | 10/2007 | Abel et al. | |
| 7,322,930 | B2 | 1/2008 | Jaeger et al. | |
| 7,376,563 | B2 | 5/2008 | Leysieffer et al. | |
| 7,421,087 | B2 * | 9/2008 | Perkins et al. | 381/328 |
| 7,444,877 | B2 | 11/2008 | Li et al. | |
| 2001/0027342 | A1 | 10/2001 | Dormer | |
| 2002/0012438 | A1 * | 1/2002 | Leysieffer et al. | 381/312 |
| 2002/0030871 | A1 | 3/2002 | Anderson et al. | |
| 2002/0086715 | A1 | 7/2002 | Sahagen | |
| 2002/0172350 | A1 | 11/2002 | Edwards et al. | |
| 2002/0183587 | A1 | 12/2002 | Dormer | |
| 2003/0064746 | A1 | 4/2003 | Rader et al. | |
| 2003/0125602 | A1 | 7/2003 | Sokolich et al. | |
| 2003/0142841 | A1 | 7/2003 | Wiegand | |
| 2003/0208099 | A1 | 11/2003 | Ball | |
| 2004/0165742 | A1 | 8/2004 | Shennib et al. | |
| 2004/0208333 | A1 | 10/2004 | Cheung et al. | |
| 2004/0234089 | A1 * | 11/2004 | Rembrand et al. | 381/312 |
| 2004/0234092 | A1 | 11/2004 | Wada et al. | |
| 2004/0240691 | A1 | 12/2004 | Grafenberg | |
| 2005/0020873 | A1 | 1/2005 | Berrang et al. | |
| 2005/0036639 | A1 | 2/2005 | Bachler et al. | |
| 2005/0163333 | A1 | 7/2005 | Abel et al. | |
| 2006/0023908 | A1 | 2/2006 | Perkins et al. | |
| 2006/0062420 | A1 | 3/2006 | Araki | |
| 2006/0107744 | A1 | 5/2006 | Li et al. | |
| 2006/0177079 | A1 | 8/2006 | Baekgaard Jensen et al. | |
| 2006/0189841 | A1 | 8/2006 | Pluvinage | |
| 2006/0233398 | A1 | 10/2006 | Husung | |
| 2007/0083078 | A1 | 4/2007 | Easter et al. | |
| 2007/0100197 | A1 | 5/2007 | Perkins et al. | |
| 2007/0127748 | A1 | 6/2007 | Carlile et al. | |
| 2007/0191673 | A1 | 8/2007 | Ball et al. | |
| 2008/0021518 | A1 | 1/2008 | Hochmair et al. | |
| 2008/0107292 | A1 | 5/2008 | Kornagel | |
| 2009/0092271 | A1 | 4/2009 | Fay et al. | |

FOREIGN PATENT DOCUMENTS

| | | | |
|---|---|---|---|
| DE | 2044870 | | 3/1972 |
| DE | 3243850 | A1 | 5/1984 |
| EP | 0 296 092 | | 12/1988 |
| FR | 2455820 | | 11/1980 |
| JP | 60-154800 | | 8/1985 |
| WO | WO 97/45074 | A1 | 12/1997 |
| WO | WO 99/03146 | | 1/1999 |
| WO | WO 99/15111 | | 4/1999 |
| WO | WO 01/50815 | A1 | 7/2001 |
| WO | WO 01/58206 | A2 | 8/2001 |
| WO | WO 03/063542 | A2 | 7/2003 |
| WO | WO 2005/015952 | | 2/2005 |
| WO | WO 2006/042298 | A2 | 4/2006 |
| WO | WO 2006/075175 | | 7/2006 |

OTHER PUBLICATIONS

Carlile, S. et al., "Spatialisation of talkers and the segregation of concurrent speech," *Abstract 1264* (Feb. 24, 2004) from <www.aro.org/abstracts/abstracts.html>.

Decraemer, W. et al., "A method for determining three-dimensional vibration in the ear," *Hearing Res.*, 77:19-37 (1994).

Fay, J.P. et al., "Cat eardrum response mechanics," Calladine Festschrift (2002), Ed. S. Pellegrino, The Netherlands, Kluwer Academic Publishers.

Hato, N. et al., "Three-dimensional stapes footplate motion in human temporal bones," *Audiol. Neurootol.*, 8:140-152 (Jan. 30, 2003).

Moore, Brian C.J., "Loudness perception and intensity resolution," *Cochlear Hearing Loss*, Chapter 4, pp. 90-115, Whurr Publishers Ltd., London (1998).

Puria, S. et al., "Sound-pressure measurements in the cochlear vestibule of human-cadaver ears," *J. Acoust. Soc. Am.*, 101(5):2754-2770 (May 1997).

Puria, Sunil and Allen, Jont B., "Measurements and model of the cat middle ear: Evidence of tympanic membrane acoustic delay," *J. Acoust. Soc. Am.*, 104(6):3463-3481 (Dec. 1998).

Baer et al., "Effects of Low Pass Filtering on the Intelligibility of Speech in Noise for People With and Without Dead Regions at High Frequencies," *J. Acost. Soc. Am* 112 (3), pt. 1, (Sep. 2002), pp. 1133-1144.

Burkhard et al., "Anthropometric Manikin for Acoustic Research," *J. Acoust. Soc. Am.*, vol. 58, No. 1, (Jul. 1975), pp. 214-222.

Fletcher, "Effects of Distortion on the Individual Speech Sounds", Chapter 18, *ASA Edition of Speech and Hearing in Communication*, Acoust Soc.of Am. (republished in 1995) pp. 415-423.

Freyman et al., "The Role of Perceived Spatial Separation in the Unmasking of Speech," *J. Acoust. Soc. Am.*, vol. 106, No. 6, (Dec. 1999) pp. 3578-3588.

Freyman et al., "Spatial Release from Informational Masking in Speech Recognition," *J. Acost Soc. Am.*, vol. 109, No. 5, pt. 1, (May 2001), pp. 2112-2122.

Hofman et al., "Relearning Sound Localization With New Ears," *Nature Neuroscience*, vol. 1, No. 5, (Sep. 1998), pp. 417-421.

Jin et al., "Speech Localization", J. Audio Eng. Soc. convention paper, presented at the *AES* 112th Convention, Munich, Germany, May 10-13, 2002, 13 pages total.

Killion, "Myths About Hearing Noise and Directional Microphones," *The Hearing Review*, vol. 11, No. 2, (Feb. 2004), pp. 14, 16, 18, 19, 72 & 73.

Martin et al. "Utility of Monaural Spectral Cues is Enhanced in the Presence of Cues to Sound-Source Lateral Angle," *JARO*, vol. 5, (2004), pp. 80-89.

Musicant et al., "Direction-Dependent Spectral Properties of Cat External Ear: New Data and Cross-Species Comparisons," *J. Acostic. Soc. Am*, May 10-13, 2002 vol. 87, No. 2, (Feb. 1990), pp. 757-781.

Shaw, "Transformation of Sound Pressure Level From the Free Field to the Eardrum in the Horizontal Plane," *J. Acoust Soc. Am.*, vol. 56, No. 6, (Dec. 1974), 1848-1861.

Vickers et al., "Effects of Low-Pass Filtering on the Intelligibility of Speech in Quiet for People With and Without Dead Regions at High Frequencies," *J. Acoust Soc. Am.*, vol. 110, No. 2, (Aug. 2001), pp. 1164-1175.

Wiener et al., "On the Sound Pressure Transformation by the Head and Auditory Meatus of the Cat", *Acta Otolaryngol.*, vol. 61, No. 3, (Mar. 1966), pp. 255-269.

Wightman et al., "Monaural Sound Localization Revisited," *J. Acoust. Soc. Am.*, vol. 101, No. 2, (Feb. 1997), pp. 1050-1063.

European Search Report and Opinion of EP Application No. 06758467.2, mailed Jun. 12, 2009, 7 pages total.

Athanassiou et al., "Laser controlled photomechanical actuation of photochromic polymers Microsystems" Rev. Adv. Mater. Sci., 2003; 5:245-251.

Ayatollahi et al., "Design and Modeling of Micromachined Condenser MEMS Loudspeaker using Permanent Magnet Neodymium-Iron-Boron (Nd-Fe-B)," IEEE International Conference on Semiconductor Electronics, 2006. ICSE '06, Oct. 29, 2006-Dec. 1, 2006; pp. 160-166.

Birch et al., "Microengineered systems for the hearing impaired," IEE Colloquium on Medical Applications of Microengineering, Jan. 31, 1996; pp. 2/1-2/5.

Camacho-Lopez et al., "Fast Liquid Crystal Elastomer Swims Into the Dark," Electronic Liquid Crystal Communications, (Nov. 26, 2003), 9 pages total.

Cheng et al., "A Silicon Microspeaker for Hearing Instruments," Journal of Micromechanics and Microengineering 2004; 14(7):859-866.

Datskos et al., "Photoinduced and thermal stress in silicon microcantilevers", Applied Physics Letters, Oct. 19, 1998; 73(16):2319-2321.

Gennum, GA3280 Preliminary Data Sheet: Voyageur TD Open Platform DSP System for Ultra Low Audio Processing, downloaded from the Internet: <<http://www.sounddesigntechnologies.com/products/pdf/37601DOC.pdf>>, Oct. 2006; 17 pages.

Gobin et al; "Comments on the physical basis of the active materials concept" Proc. SPIE 4512:84-92, 2001.

Killion, "SNR loss: I can hear what people say but I can't understand them," The Hearing Review, 1997; 4(12):8-14.

Lee et al., "A Novel Opto-Electromagnetic Actuator Coupled to the tympanic Membrane" Journal of Biomechanics, 2008; 41(16): 3515-3518.

Lee et al., "The Optimal Magnetic Force for a Novel Actuator Coupled to the Tympanic Membrane: A Finite Element Analysis," Biomedical Engineering: Applications, Basis and Communications, 2007; 19(3):171-177.

Lezal, "Chalcogenide glasses—survey and progress", J. Optoelectron Adv Mater., Mar. 2003; 5 (1):23-34.

Murugasu et al., "Malleus-to-footplate versus malleus-to-stapes-head ossicular reconstruction prostheses: temporal bone pressure gain measurements and clinical audiological data," Otol Neurotol. Jul. 2005;26(4):572-582.

National Semiconductor, LM4673 Boomer: Filterless, 2.65W, Mono, Class D Audio Power Amplifier, [Data Sheet] downloaded from the Internet: <<http://www.national.com/ds/LM/LM4673.pdf>>; Nov. 1, 2007; 24 pages.

Poosanaas et al., "Influence of sample thickness on the performance of photostrictive ceramics," J. App. Phys., Aug. 1, 1998, 84(3):1508-1512.

Puria et al., "Malleus-to-footplate ossicular reconstruction prosthesis positioning: cochleovestibular pressure optimization", Otol Neurotol. May 2005;26(3):368-379.

Puria et al., "Middle Ear Morphometry From Cadaveric Temporal Bone MicroCT Imaging," Proceedings of the 4th International Symposium, Zurich, Switzerland, Jul. 27-30, 2006, Middle Ear Mechanics in Research and Otology, pp. 259-268.

Sound Design Technologies, "Voyager TD™ Open Platform DSP System for Ultra Low Power Audio Processing—GA3280 Data Sheet", Oct. 2007; retrieved from the Internet: <<http://www.sound-des.com/pdf/37601DOC.pdf>>, 15 page total.

Shih, "Shape and displacement control of beams with various boundary conditions via photostrictive optical actuators," Proc. IMECE (Nov. 2003), pp. 1-10.

Stuchlik et al, "Micro-Nano actuators driven by polarized light", IEEE Proc. Sci. Meas. Techn. Mar. 2004, 151(2::131-136.

Suski et al., Optically activated ZnO/SiO2/Si cantilever beams, Sensors & Actuators, 1990; 24:221-225.

Takagi et al.; "Mechanochemical Synthesis of Piezoelectric PLZT Powder", *KONA*, 2003, 151(21):234-241.

Thakoor et al., "Optical microactuation in piezoceramics", Proc. SPIE, Jul. 1998; 3328:376-391.

Tzou et al; "Smart Materials, Precision Sensors/Actuators, Smart Structures, and Structronic Systems", *Mechanics of Advanced Materials and Structures*, 2004;11:367-393.

Uchino et al.; "Photostricitve actuators," *Ferroelectrics* 2001; 258:147-158.

Yi et al., "Piezoelectric Microspeaker with Compressive Nitride Diaphragm," The Fifteenth IEEE International Conference on Micro Electro Mechanical Systems, 2002; pp. 260-263.

Yu et al. "Photomechanics: Directed bending of a polymer film by light", Nature, Sep. 2003; 425(6954):145.

U.S. Appl. No. 61/073,271, filed Jun. 17, 2008, inventor: Lee Felsenstein.

U.S. Appl. No. 61/073,281, filed Jun. 17, 2008, inventor: Lee Felsenstein.

U.S. Appl. No. 60/702,532, filed Jul. 25, 2005, inventor: Nikolai Aljuri.

U.S. Appl. No. 61/099,087, filed Sep. 22, 2008, inventor: Paul Rucker.

* cited by examiner

HEARING SYSTEM HAVING AN OPEN CHAMBER FOR HOUSING COMPONENTS AND REDUCING THE OCCLUSION EFFECT

BACKGROUND OF THE INVENTION

1. Field of the Invention

The present invention relates to hearing methods and systems. More specifically, the present invention relates to methods and systems that have improved high frequency response that improves the speech reception threshold (SRT) and preserves and transmits high frequency spatial localization cues to the middle or inner ear. Such systems may be used to enhance the hearing process with normal or impaired hearing.

Previous studies have shown that when the bandwidth of speech is low pass filtered, that speech intelligibility does not improve for bandwidths above about 3 kHz (Fletcher 1995), which is the reason why the telephone system was designed with a bandwidth limit to about 3.5 kHz, and also why hearing aid bandwidths are limited to frequencies below about 5.7 kHz (Killion 2004). It is now evident that there is significant energy in speech above about 5 kHz (Jin et al., *J. Audio Eng. Soc.*, Munich 2002). Furthermore, hearing impaired subjects, with amplified speech, perform better with increased bandwidth in quiet (Vickers et al. 2001) and in noisy situations (Baer et al. 2002). This is especially true in subjects that do not have dead regions in the cochlea at the high frequencies (Moore, "Loudness perception and intensity resolution," Cochlear Hearing Loss, Chapter 4, pp. 90-115, Whurr Publishers Ltd., London 1998). Thus, subjects with hearing aids having greater bandwidth than the existing 5.7 kHz bandwidths can be expected to have improved performance in quiet and in diffuse-field noisy conditions.

Numerous studies, both in humans (Shaw 1974) and in cats (Musicant et al. 1990) have shown that sound pressure at the ear canal entrance varies with the location of the sound source for frequencies above 5 kHz. This spatial filtering is due to the diffraction of the incoming sound wave by the pinna. It is well established that these diffraction cues help in the perception of spatial localization (Best et al., "The influence of high frequencies on speech localization," Abstract 981 (Feb. 24, 2003) from <www.aro.org/abstracts/abstracts.html>). Due to the limited bandwidth of conventional hearing aids, some of the spatial localization cues are removed from the signal that is delivered to the middle and/or inner ear. Thus, it is oftentimes not possible for wearers of conventional hearing aids to accurately externalize talkers, which requires speech energy above 5 kHz.

The eardrum to ear canal entrance pressure ratio has a 10 dB resonance at about 3.5 kHz (Wiener et al. 1966; Shaw 1974). This is independent of the sound source location in the horizontal plane (Burkhard and Sachs 1975). This ratio is a function of the dimensions and consequent relative acoustic impedance of the eardrum and the ear canal. Thus, once the diffracted sound wave propagates past the entrance of the ear canal, there is no further spatial filtering. In other words, for spatial localization, there is no advantage to placing the microphone any more medial than near the entrance of the ear canal. The 10 dB resonance is typically added in most hearing aids after the microphone input because this gain is not spatially dependent.

Evidence is now growing that the perception of the differences in the spatial locations of multiple talkers aid in the segregation of concurrent speech (Freyman et al. 1999; Freyman et al. 2001). Consistent with other studies, Carlile et al., "Spatialisation of talkers and the segregation of concurrent speech," Abstract 1264 (Feb. 24, 2004) from <www.aro.org/abstracts/abstracts.html>, showed a speech reception threshold (SRT) of −4 dB under diotic conditions, where speech and masker noise at the two ears are the same, and −20 dB with speech maskers spatially separated by 30 degrees. But when the speech signal was low pass filtered to 5 kHz, the SRT decreased to −15 dB. While previous single channel studies have indicated that information in speech above 5 kHz does not contribute to speech intelligibility, these data indicate that as much as 5 dB unmasking afforded by externalization percept was much reduced when compared to the wide bandwidth presentation over virtual auditory simulations. The 5 dB improvement in SRT is mostly due to central mechanisms. However, at this point, it is not clear how much of the 5 dB improvement can be attained with auditory cues through a single channel (e.g., one ear).

It has recently been described in P. M. Hofman et al., "Relearning sound localization with new ears," *Nature Neuroscience*, vol. 1, no. 5, September 1998, that sound localization relies on the neural processing of implicit acoustic cues. Hofman et al. found that accurate localization on the basis of spectral cues poses constraints on the sound spectrum, and that a sound needs to be broad-band in order to yield sufficient spectral shape information. However, with conventional hearing systems, because the ear canal is often completely blocked and because conventional hearing systems often have a low bandwidth filter, such conventional systems will not allow the user to receive the three-dimensional localization spatial cues.

Furthermore, Wightman and Kistler (1997) found that listeners do not localize virtual sources of sound when sound is presented to only one ear. This suggests that high-frequency spectral cues presented to one ear through a hearing device may not be beneficial. Martin et al. (2004) recently showed that when the signal to one ear is low-pass filtered (2.5 kHz), thus preserving binaural information regarding sound-source lateral angle, monaural spectral cues to the opposite ear could correctly interpret elevation and front-back hemi-field cues. This says that a subject with one wide-band hearing aid can localize sounds with that hearing aid, provided that the opposite ear does not have significant low-frequency hearing loss, and thus able to process inter-aural time difference cues. The improvement in unmasking due to externalization observed by Carlile et al. (2004) should at least be possible with monaural amplification. The open question is how much of the 5 dB improvement in SRT can be realized monaurally and with a device that partially blocks the auditory ear canal.

Head related transfer functions (HRTFs) are due to the diffraction of the incoming sound wave by the pinna. Another factor that determines the measured HRTF is the opening of the ear canal itself. It is conceivable that a device in the ear canal that partially blocks it and thus will alter HRTFs, can eliminate directionally dependent pinna cues. Burkhard and Sachs (1975) have shown that when the canal is blocked, spatially dependent vertical localization cues are modified but nevertheless present. Some relearning of the new cues may be required to obtain benefit from the high frequency cues. Hoffman et al. (1998) showed that this learning takes place over a period of less than 45 days.

Presently, most conventional hearing systems fall into at least three categories: acoustic hearing systems, electromagnetic drive hearing systems, and cochlear implants. Acoustic hearing systems rely on acoustic transducers that produce amplified sound waves which, in turn, impart vibrations to the tympanic membrane or eardrum. The telephone earpiece, radio, television and aids for the hearing impaired are all examples of systems that employ acoustic drive mechanisms. The telephone earpiece, for instance, converts signals transmitted on a wire into vibrational energy in a speaker which generates acoustic energy. This acoustic energy propagates in the ear canal and vibrates the tympanic membrane. These vibrations, at varying frequencies and amplitudes, result in the perception of sound. Surgically implanted cochlear implants electrically stimulate the auditory nerve ganglion cells or dendrites in subjects having profound hearing loss.

Hearing systems that deliver audio information to the ear through electromagnetic transducers are well known. These transducers convert electromagnetic fields, modulated to contain audio information, into vibrations which are imparted to the tympanic membrane or parts of the middle ear. The transducer, typically a magnet, is subjected to displacement by electromagnetic fields to impart vibrational motion to the portion to which it is attached, thus producing sound perception by the wearer of such an electromagnetically driven system. This method of sound perception possesses some advantages over acoustic drive systems in terms of quality, efficiency, and most importantly, significant reduction of "feedback," a problem common to acoustic hearing systems.

Feedback in acoustic hearing systems occurs when a portion of the acoustic output energy returns or "feeds back" to the input transducer (microphone), thus causing self-sustained oscillation. The potential for feedback is generally proportional to the amplification level of the system and, therefore, the output gain of many acoustic drive systems has to be reduced to less than a desirable level to prevent a feedback situation. This problem, which results in output gain inadequate to compensate for hearing losses in particularly severe cases, continues to be a major problem with acoustic type hearing aids. To minimize the feedback to the microphone, many acoustic hearing devices close off, or provide minimal venting, to the ear canal. Although feedback may be reduced, the tradeoff is "occlusion," a tunnel-like hearing sensation that is problematic to most hearing aid users. Directly driving the eardrum can minimize the feedback because the drive mechanism is mechanical rather than acoustic. Because of the mechanically vibrating eardrum, sound is coupled to the ear canal and wave propagation is supported in the reverse direction. The mechanical to acoustic coupling, however, is not efficient and this inefficiency is exploited in terms of decreased sound in the ear canal resulting in increased system gain.

One system, which non-invasively couples a magnet to tympanic membrane and solves some of the aforementioned problems, is disclosed by Perkins et al. in U.S. Pat. No. 5,259,032, which is hereby incorporated by reference. The Perkins patent discloses a device for producing electromagnetic signals having a transducer assembly which is weakly but sufficiently affixed to the tympanic membrane of the wearer by surface adhesion. U.S. Pat. No. 5,425,104, also incorporated herein by reference, discloses a device for producing electromagnetic signals incorporating a drive means external to the acoustic canal of the individual. However, because magnetic fields decrease in strength as the reciprocal of the square of the distance ($1/R^2$), previous methods for generating audio carrying magnetic fields are highly inefficient and are thus not practical.

While the conventional hearing aids have been relatively successful at improving hearing, the conventional hearing aids have not been able to significantly improve preservation of high-frequency spatial localization cues. For these reasons it would be desirable to provide an improved hearing systems.

2. Description of the Background Art

U.S. Pat. Nos. 5,259,032 and 5,425,104 have been described above. Other patents of interest include: U.S. Pat. Nos. 5,015,225; 5,276,910; 5,456,654; 5,797,834; 6,084,975; 6,137,889; 6,277,148; 6,339,648; 6,354,990; 6,366,863; 6,387,039; 6,432,248; 6,436,028; 6,438,244; 6,473,512; 6,475,134; 6,592,513; 6,603,860; 6,629,922; 6,676,592; and 6,695,943. Other publications of interest include: U.S. Patent Publication Nos. 2002-0183587, 2001-0027342; Journal publications Decraemer et al., "A method for determining three-dimensional vibration in the ear," *Hearing Res.,* 77:19-37 (1994); Puria et al., "Sound-pressure measurements in the cochlear vestibule of human cadaver ears," *J. Acoust. Soc. Am.,* 101(5):2754-2770 (May 1997); Moore, "Loudness perception and intensity resolution," *Cochlear Hearing Loss*, Chapter 4, pp. 90-115, Whurr Publishers Ltd., London (1998); Puria and Allen "Measurements and model of the cat middle ear: Evidence of tympanic membrane acoustic delay," *J. Acoust. Soc. Am.,* 104(6):3463-3481 (December 1998); Hoffman et al. (1998); Fay et al., "Cat eardrum response mechanics," Calladine Festschrift (2002), Ed. S. Pellegrino, The Netherlands, Kluwer Academic Publishers; and Hato et al., "Three-dimensional stapes footplate motion in human temporal bones," *Audiol. Neurootol.,* 8:140-152 (Jan. 30, 2003). Conference presentation abstracts: Best et al., "The influence of high frequencies on speech localization," Abstract 981 (Feb. 24, 2003) from <www.aro.org/abstracts/abstracts.html>, and Carlile et al., "Spatialisation of talkers and the segregation of concurrent speech," Abstract 1264 (Feb. 24, 2004) from <www.aro.org/abstracts/abstracts.html>.

BRIEF SUMMARY OF THE INVENTION

The present invention provides hearing system and methods that have an improved high frequency response that improves the speech reception threshold and preserves high frequency spatial localization cues to the middle or inner ear.

The hearing systems constructed in accordance with the principles of the present invention generally comprise an input transducer assembly, a transmitter assembly, and an output transducer assembly. The input transducer assembly will receive a sound input, typically either ambient sound (in the case of hearing aids for hearing impaired individuals) or an electronic sound signal from a sound producing or receiving device, such as the telephone, a cellular telephone, a radio, a digital audio unit, or any one of a wide variety of other telecommunication and/or entertainment devices. The input transducer assembly will send a signal to the transmitter assembly where the transmitter assembly processes the signal from the transducer assembly to produce a processed signal which is modulated in some way, to represent or encode a sound signal which substantially represents the sound input received by the input transducer assembly. The exact nature of the processed output signal will be selected to be used by the output transducer assembly to provide both the power and the signal so that the output transducer assembly can produce mechanical vibrations, acoustical output, pressure output, (or other output) which, when properly coupled to a subject's hearing transduction pathway, will induce neural impulses in the subject which will be interpreted by the subject as the original sound input, or at least something reasonably representative of the original sound input.

At least some of the components of the hearing system of the present invention are disposed within a shell or housing that is placed within the subject's auditory ear canal. Typically, the shell has one or more openings on both a first end and a second end so as to provide an open ear canal and to allow ambient sound (such as low and high frequency three dimensional localization cues ) to be directly delivered to the tympanic membrane at a high level. Advantageously, the openings in the shell do not block the auditory canal and minimize interference with the normal pressurization of the ear. In some embodiments, the shell houses the input transducer, the transmitter assembly, and a battery. In other embodiments, portions of the transmitter assembly and the battery may be placed behind the ear (BTE), while the input transducer is positioned in the shell.

In the case of hearing aids, the input transducer assembly typically comprises a microphone in the housing that is disposed within the auditory ear canal. Suitable microphones are well known in the hearing aid industry and amply described in the patent and technical literature. The microphones will typically produce an electrical output is received by the transmitter assembly which in turn will produce the processed signal. In the case of ear pieces and other hearing systems, the sound input to the input transducer assembly will typically be electronic, such as from a telephone, cell phone, a portable entertainment unit, or the like. In such cases, the input transducer assembly will typically have a suitable amplifier or other electronic interface which receives the electronic sound input and which produces a filtered electronic output suitable for driving the output transducer assembly.

While it is possible to position the microphone behind the pinna, in the temple piece of eyeglasses, or elsewhere on the subject, it is preferable to position the microphone within the ear canal so that the microphone receives and transmits the higher frequency signals that are directed into the ear canal and to thus improve the final SRT.

The transmitter assembly of the present invention typically comprises a digital signal processor that processes the electrical signal from the input transducer and delivers a signal to a transmitter element that produces the processed output signal that actuates the output transducer. The digital signal processor will often have a filter that has a frequency response bandwidth that is typically greater than 6 kHz, more preferably between about 6 kHz and about 20 kHz, and most preferably between about 7 kHz and 13 kHz. Such a transmitter assembly differs from conventional transmitters found in that the higher bandwidth results in greater preservation of spatial localization cues for microphones that are placed at the entrance of the ear canal or within the ear canal.

In one embodiment, the transmitter element that is in communication with the digital signal processor is in the form of a coil that has an open interior and a core sized to fit within the open interior of the coil. A power source is coupled to the coil to supply a current to the coil. The current delivered to the coil will substantially correspond to the electrical signal processed by the digital signal processor. One useful electromagnetic-based assembly is described in commonly owned, copending U.S. patent application Ser. No. 10/902,660, filed Jul. 28, 2004, entitled "Improved Transducer for Electromagnetic Hearing Devices," the complete disclosure of which is incorporated herein by reference.

The output transducer assembly of the present invention may be any component that is able to receive the processed signal from the transmitter assembly. The output transducer assembly will typically be configured to couple to some point in the hearing transduction pathway of the subject in order to induce neural impulses which are interpreted as sound by the subject. Typically, a portion of the output transducer assembly will couple to the tympanic membrane, a bone in the ossicular chain, or directly to the cochlea where it is positioned to vibrate fluid within the cochlea. Specific points of attachment are described in prior U.S. Pat. Nos. 5,259,032; 5,456,654; 6,084,975; and 6,629,922, the full disclosures of which have been incorporated herein by reference.

In one embodiment, the present invention provides a hearing system that has an input transducer that is positionable within an ear canal of a user to capture ambient sound that enters the ear canal of the user. A transmitter assembly receives electrical signals from the input transducer. The transmitter assembly comprises a signal processor that has a frequency response bandwidth in a 6.0 kHz to 20 kHz range. The transmitter assembly is configured to deliver filtered signals to an output transducer positioned in a middle or inner ear of the user, wherein the filtered signal is representative of the ambient sound received by the input transducer. A configuration of the input transducer and transmitter assembly provides an open ear canal that allows ambient sound to directly reach the middle ear of the user.

In another embodiment, the present invention provides a method. The method comprises positioning an input transducer within an ear canal of a user and transmitting signals from the input transducer that are indicative of ambient sound received by the input transducer to a transmitter assembly. The signals are processed (e.g., filtered) at the transmitter assembly with a signal processor that has a filter that has a bandwidth that is larger than about 6.0 kHz. The filtered signals are delivered to a middle ear or inner ear of the user. The positioning of the input transducer and transmitter assembly provides an open ear canal that allows non-filtered ambient sound to directly reach the middle ear of the user.

As noted above, in preferred embodiments, the signal processor has a bandwidth between about 6 kHz and about 20 kHz, so as to allow for preservation and transmission of the high frequency spatial localization cues.

While the remaining discussion will focus on the use of an electromagnetic transmitter assembly and output transducer, it should be appreciated that the present invention is not limited to such transmitter assemblies, and various other types of transmitter assemblies may be used with the present invention. For example, the photo-mechanical hearing transduction assembly described in co-pending and commonly owned, U.S. Provisional Patent Application Ser. No. 60/618,408, filed Oct. 12, 2004, entitled "Systems and Methods for Photo-mechanical Hearing Transduction," the complete disclosure of which is incorporated herein by reference, may be used with the hearing systems of the present invention. Furthermore, other transmitter assemblies, such as optical transmitters, ultrasound transmitters, infrared transmitters, acoustical transmitters, or fluid pressure transmitters, or the like may take advantage of the principles of the present invention.

The above aspects and other aspects of the present invention may be more fully understood from the following detailed description, taken together with the accompanying drawings.

DETAILED DESCRIPTION OF THE INVENTION

Figure 1:
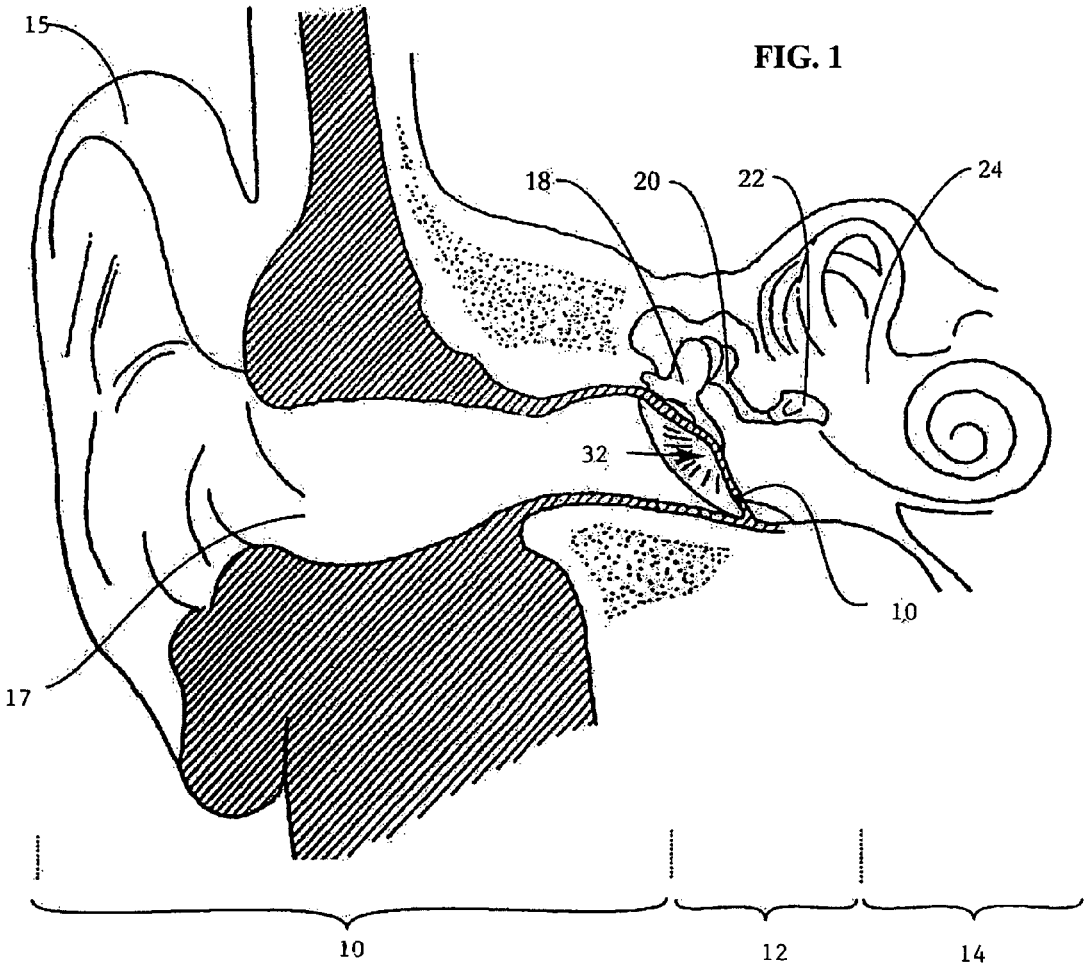
FIG. 1 is a cross-sectional view of a human ear, including an outer ear, middle ear, and part of an inner ear.

Referring now to FIG. 1, there is shown a cross sectional view of an outer ear 10, middle ear 12 and a portion of an inner ear 14. The outer ear 10 comprises primarily of the pinna 15 and the auditory ear canal 17. The middle ear 12 is bounded by the tympanic membrane (ear drum) 16 on one side, and contains a series of three tiny interconnected bones: the malleus (hammer) 18; the incus (anvil) 20; and the stapes (stirrup) 22. Collectively, these three bones are known as the ossicles or the ossicular chain. The malleus 18 is attached to the tympanic membrane 16 while the stapes 22, the last bone in the ossicular chain, is coupled to the cochlea 24 of the inner ear.

In normal hearing, sound waves that travel via the outer ear or auditory ear canal 17 strike the tympanic membrane 16 and cause it to vibrate. The malleus 18, being connected to the tympanic membrane 16, is thus also set into motion, along with the incus 20 and the stapes 22. These three bones in the ossicular chain act as a set of impedance matching levers of the tiny mechanical vibrations received by the tympanic membrane. The tympanic membrane 16 and the bones may act as a transmission line system to maximize the bandwidth of the hearing apparatus (Puria and Allen, 1998). The stapes vibrates in turn causing fluid pressure in the vestibule of a spiral structure known as the cochlea 24 (Puria et al. 1997). The fluid pressure results in a traveling wave along the longitudinal axis of the basilar membrane (not shown). The organ of Corti sits atop the basilar membrane which contains the sensory epithelium consisting of one row of inner hair cells and three rows of outer hair cells. The inner-hair cells (not shown) in the cochlea are stimulated by the movement of the basilar membrane. There, hydraulic pressure displaces the inner ear fluid and mechanical energy in the hair cells is transformed into electrical impulses, which are transmitted to neural pathways and the hearing center of the brain (temporal lobe), resulting in the perception of sound. The outer hair cells are believed to amplify and compress the input to the inner hair cells. When there is sensory-neural hearing loss, the outer hair cells are typically damaged, thus reducing the input to the inner hair cells which results in a reduction in the perception of sound. Amplification by a hearing system may fully or partially restore the otherwise normal amplification and compression provided by the outer hair cells.

Figure 2:
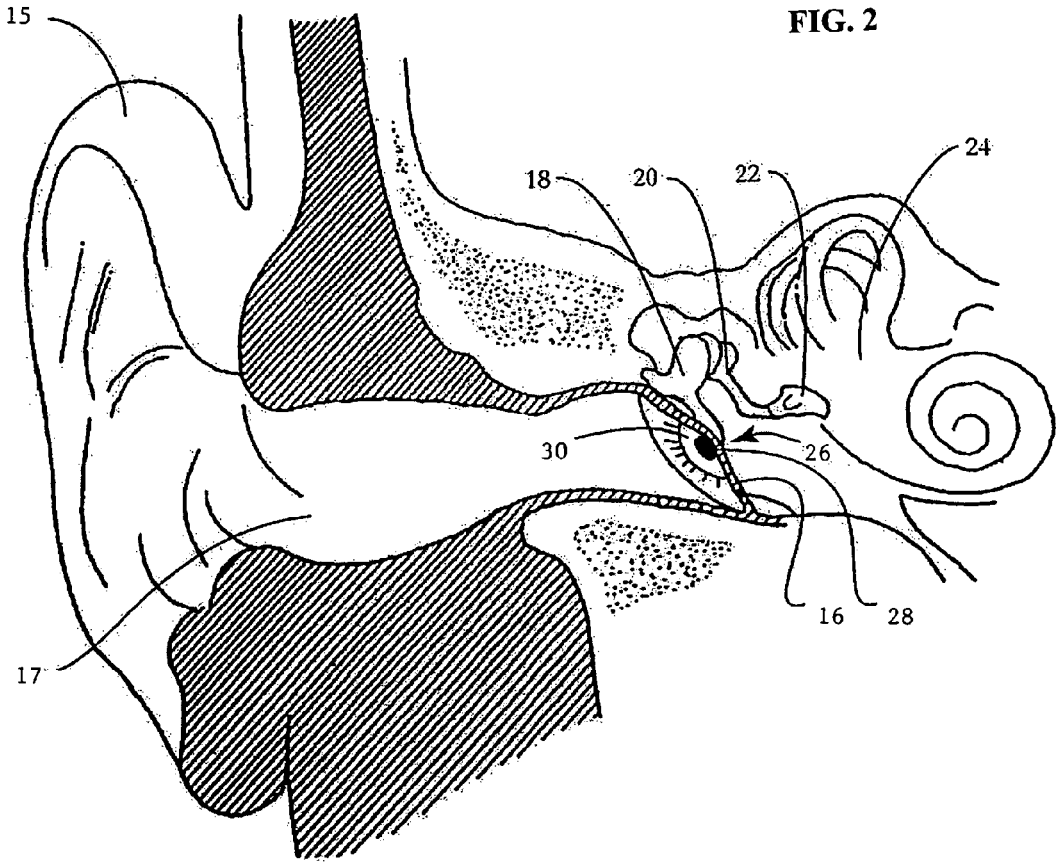
FIG. 2 illustrates an embodiment of the present invention with a transducer coupled to a tympanic membrane.

A presently preferred coupling point of the output transducer assembly is on the outer surface of the tympanic membrane 16 and is illustrated in FIG. 2. In the illustrated embodiment, the output transducer assembly 26 comprises a transducer 28 that is placed in contact with an exterior surface of the tympanic membrane 10. The transducer 28 generally comprises a high-energy permanent magnet. A preferred method of positioning the transducer is to employ a contact transducer assembly that includes transducer 28 and a support assembly 30. Support assembly 30 is attached to, or floating on, a portion of the tympanic membrane 16. The support assembly is a biocompatible structure with a surface area sufficient to support the transducer 28, and is vibrationally coupled to the tympanic membrane 16.

Preferably, the surface of support assembly 30 that is attached to the tympanic membrane substantially conforms to the shape of the corresponding surface of the tympanic membrane, particularly the umbo area 32. In one embodiment, the support assembly 30 is a conically shaped film in which the transducer is embedded therein. In such embodiments, the film is releasably contacted with a surface of the tympanic membrane. Alternatively, a surface wetting agent, such as mineral oil, is preferably used to enhance the ability of support assembly 30 to form a weak but sufficient attachment to the tympanic membrane 16 through surface adhesion. One suitable contact transducer assembly is described in U.S. Pat. No. 5,259,032, which was previously incorporated herein by reference.

Figure 3A:
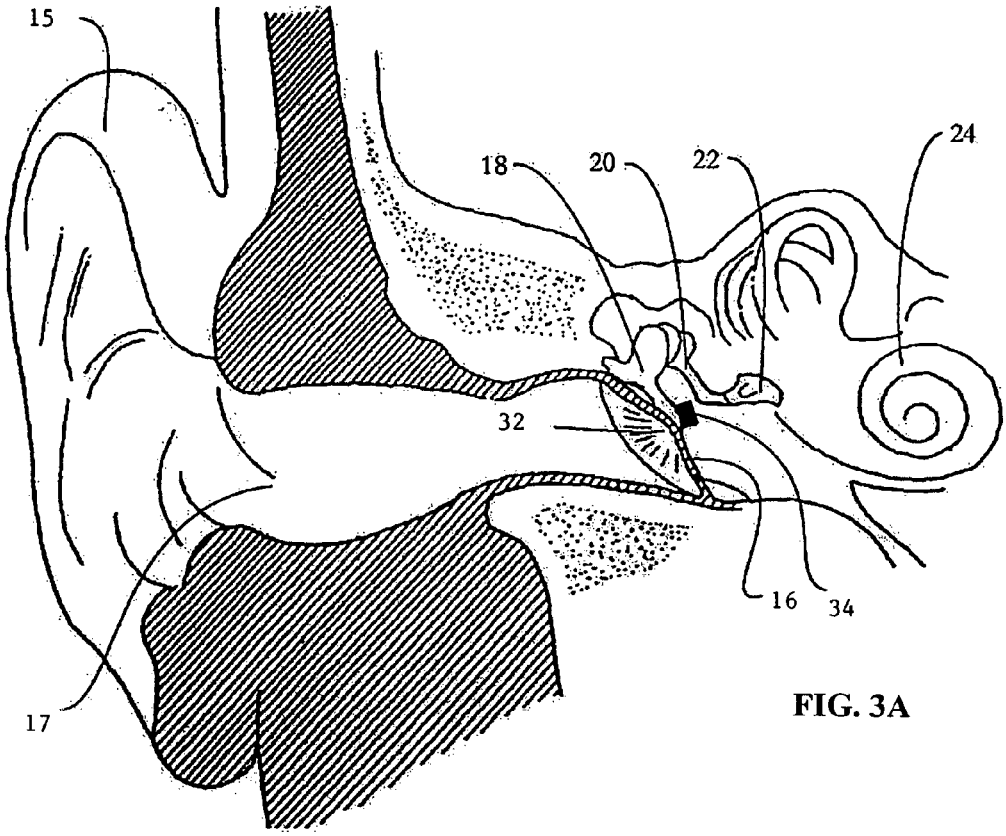
FIGS. 3A and 3B illustrate alternative embodiments of the transducer coupled to a malleus.
Figure 3B:
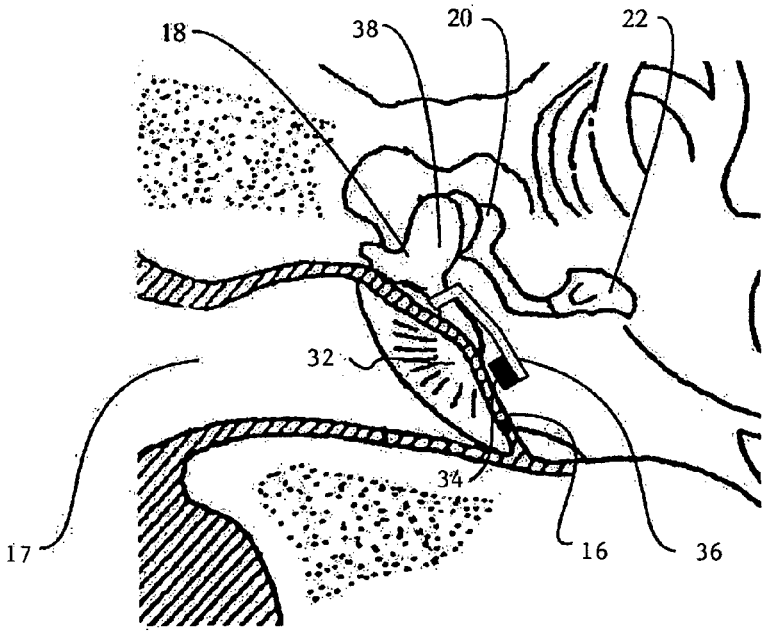

FIGS. 3A and 3B illustrate alternative embodiments wherein a transducer is placed on the malleus of an individual. In FIG. 3A, a transducer magnet 34 is attached to the medial side of the inferior manubrium. Preferably, magnet 34 is encased in titanium or other biocompatible material. By way of illustration, one method of attaching magnet 34 to the malleus is disclosed in U.S. Pat. No. 6,084,975, previously incorporated herein by reference, wherein magnet 34 is attached to the medial surface of the manubrium of the malleus 18 by making an incision in the posterior periosteum of the lower manubrium, and elevating the periosteum from the manubrium, thus creating a pocket between the lateral surface of the manubrium and the tympanic membrane 10. One prong of a stainless steel clip device may be placed into the pocket, with the transducer magnet 34 attached thereto. The interior of the clip is of appropriate dimension such that the clip now holds onto the manubrium placing the magnet on its medial surface.

Alternatively, FIG. 3B illustrates an embodiment wherein clip 36 is secured around the neck of the malleus 18, in between the manubrium and the head 38 of the malleus. In this embodiment, the clip 36 extends to provide a platform of orienting the transducer magnet 34 toward the tympanic membrane 16 and ear canal 17 such that the transducer magnet 34 is in a substantially optimal position to receive signals from the transmitter assembly.

Figure 4A:
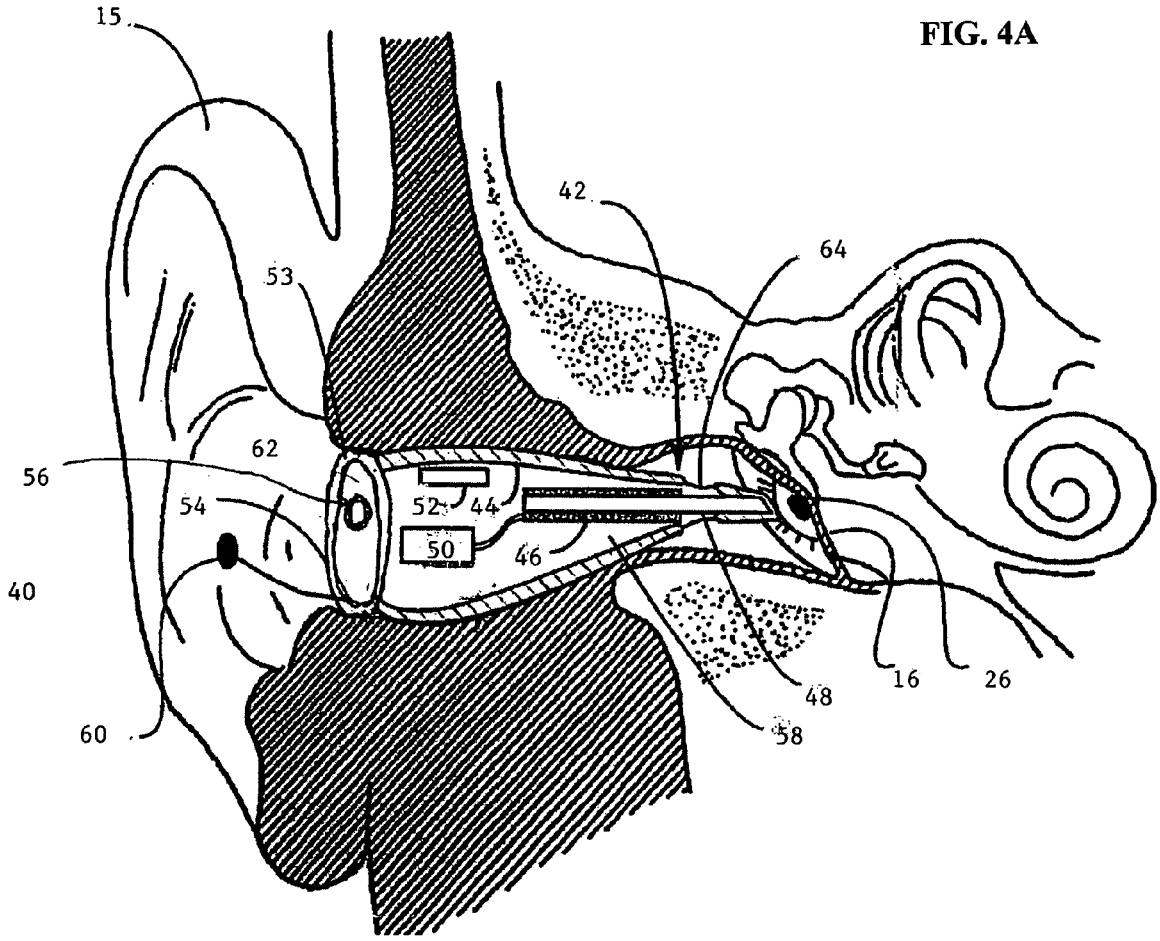
FIG. 4A schematically illustrates a hearing system of the present invention that provides an open ear canal so as to allow ambient sound/acoustic signals to directly reach the tympanic membrane.

FIG. 4A illustrates one preferred embodiment of a hearing system 40 encompassed by the present invention. The hearing system 40 comprises the transmitter assembly 42 (illustrated with shell 44 cross-sectioned for clarity) that is installed in a right ear canal and oriented with respect to the magnetic transducer 28 on the tympanic membrane 16. In the preferred embodiment of the current invention, the transducer 28 is positioned against tympanic membrane 16 at umbo area 32. The transducer may also be placed on other acoustic members of the middle ear, including locations on the malleus 18 (shown in FIGS. 3A and 3B), incus 20, and stapes 22. When placed in the umbo area 32 of the tympanic membrane 16, the transducer 28 will be naturally tilted with respect to the ear canal 17. The degree of tilt will vary from individual to individual, but is typically at about a 60-degree angle with respect to the ear canal.

The transmitter assembly 42 has a shell 44 configured to mate with the characteristics of the individual's ear canal wall. Shell 44 is preferably matched to fit snug in the individual's ear canal so that the transmitter assembly 42 may repeatedly be inserted or removed from the ear canal and still be properly aligned when re-inserted in the individual's ear.

In the illustrated embodiment, shell 44 is also configured to support a coil 46 and a core 48 such that the tip of core 48 is positioned at a proper distance and orientation in relation to the transducer 28 when the transmitter assembly 42 is properly installed in the ear canal 17. The core 48 generally comprises ferrite, but may be any material with high magnetic permeability.

In a preferred embodiment, coil 46 is wrapped around the circumference of the core 48 along part or all of the length of the core. Generally, the coil has a sufficient number of rotations to optimally drive an electromagnetic field toward the transducer 28. The number of rotations may vary depending on the diameter of the coil, the diameter of the core, the length of the core, and the overall acceptable diameter of the coil and core assembly based on the size of the individual's ear canal. Generally, the force applied by the magnetic field on the magnet will increase, and therefore increase the efficiency of the system, with an increase in the diameter of the core. These parameters will be constrained, however, by the anatomical limitations of the individual's ear. The coil 46 may be wrapped around only a portion of the length of the core, as shown in FIG. 4A, allowing the tip of the core to extend further into the ear canal 17, which generally converges as it reaches the tympanic membrane 16.

One method for matching the shell 44 to the internal dimensions of the ear canal is to make an impression of the ear canal cavity, including the tympanic membrane. A positive investment is then made from the negative impression. The outer surface of the shell is then formed from the positive investment which replicated the external surface of the impression. The coil 46 and core 48 assembly can then be positioned and mounted in the shell 44 according to the desired orientation with respect to the projected placement of the transducer 28, which may be determined from the positive investment of the ear canal and tympanic membrane. In an alternative embodiment, the transmitter assembly 42 may also incorporate a mounting platform (not shown) with micro-adjustment capability for orienting the coil and core assembly such that the core can be oriented and positioned with respect to the shell and/or the coil. In another alternative embodiment, a CT, MRI or optical scan may be performed on the individual to generate a 3D model of the ear canal and the tympanic membrane. The digital 3D model representation may then be used to form the outside surface of the shell 44 and mount the core and coil.

As shown in the embodiment of FIG. 4A, transmitter assembly 42 may also comprise a digital signal processing (DSP) unit and other components 50 and a battery 52 that are placed inside shell 44. The proximal end 53 of the shell 44 is open 54 and has the input transducer (microphone) 56 positioned on the shell so as to directly receive the ambient sound that enters the auditory ear canal 17. The open chamber 58 provides access to the shell 44 and transmitter assembly 42 components contained therein. A pull line 60 may also be incorporated into the shell 44 so that the transmitter assembly can be readily removed from the ear canal.

Advantageously, in many embodiments, an acoustic opening 62 of the shell allows ambient sound to enter the open chamber 58 of the shell. This allows ambient sound to travel through the open volume 58 along the internal compartment of the transmitter assembly 42 and through one or more openings 64 at the distal end of the shell 44. Thus, ambient sound waves may reach and directly vibrate the tympanic membrane 16 and separately impart vibration on the tympanic membrane. This open-channel design provides a number of substantial benefits. First, the open channel 17 minimizes the occlusive effect prevalent in many acoustic hearing systems from blocking the ear canal. Second, the open channel allows the high frequency spatial localization cues to be directly transmitted to the tympanic membrane 17. Third, the natural ambient sound entering the ear canal 16 allows the electromagnetically driven effective sound level output to be limited or cut off at a much lower level than with a hearing system that blocks the ear canal 17. Finally, having a fully open shell preserves the natural pinna diffraction cues of the subject and thus little to no acclimatization, as described by Hoffman et al. (1998), is required.

Figure 5:
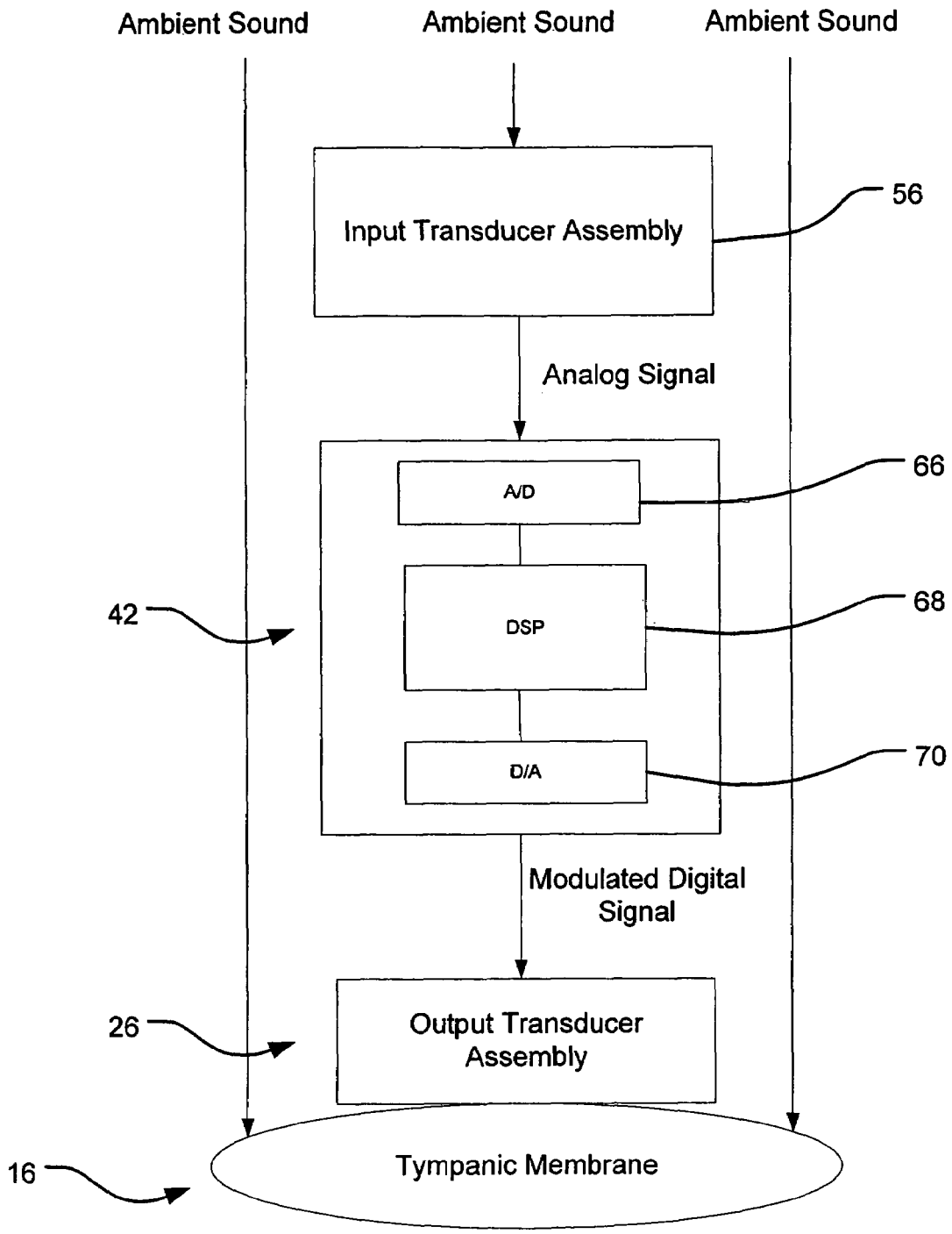
FIG. 5 schematically illustrates a hearing system embodied by the present invention.

As shown schematically in FIG. 5, in operation, ambient sound entering the auricle and ear canal 17 is captured by the microphone 56 that is positioned within the open ear canal 17. The microphone 56 converts sound waves into analog electrical signals for processing by a DSP unit 68 of the transmitter assembly 42. The DSP unit 68 may optionally be coupled to an input amplifier (not shown) to amplify the electrical signal. The DSP unit 68 typically includes an analog-to-digital converter 66 that converts the analog electrical signal to a digital signal. The digital signal is then processed by any number of digital signal processors and filters 68. The processing may comprise of any combination of frequency filters, multi-band compression, noise suppression and noise reduction algorithms. The digitally processed signal is then converted back to analog signal with a digital-to-analog converter 70. The analog signal is shaped and amplified and sent to the coil 46, which generates a modulated electromagnetic field containing audio information representative of the original audio signal and, along with the core 48, directs the electromagnetic field toward the transducer magnet 28. The transducer magnet 28 vibrates in response to the electromagnetic field, thereby vibrating the middle-ear acoustic member to which it is coupled (e.g. the tympanic membrane 16 in FIG. 4A or the malleus 18 in FIGS. 3A and 3B).

In one preferred embodiment, the transmitter assembly 42 comprises a filter that has a frequency response bandwidth that is typically greater than 6 kHz, more preferably between about 6 kHz and about 20 kHz, and most preferably between about 6 kHz and 13 kHz. Such a transmitter assembly 42 differs from conventional transmitters found in conventional hearing aids in that the higher bandwidth results in greater preservation of spatial localization cues for microphones 56 that are placed at the entrance of the auditory ear canal or within the ear canal 17. The positioning of the microphone 56 and the higher bandwidth filter results in a speech reception threshold improvement of up to 5 dB above existing hearing systems where there are interfering speech sources. Such a significant improvement in SRT, due to central mechanisms, is not possible with existing hearing aids with limited bandwidth, limited gain and sound processing without pinna diffraction cues.

For most hearing-impaired subjects, sound reproduction at higher decibel ranges is not necessary because their natural hearing mechanisms are still capable of receiving sound in that range. To those familiar in the art, this is commonly referred to as the recruitment phenomena where the loudness perception of a hearing impaired subject "catches up" with the loudness perception of a normal hearing person at loud sounds (Moore, 1998). Thus, the open-channel device may be configured to switch off, or saturate, at levels where natural acoustic hearing takes over. This can greatly reduce the currents required to drive the transmitter assembly, allowing for smaller batteries and/or longer battery life. A large opening is not possible in acoustic hearing aids because of the increase in feedback and thus limiting the functional gain of the device. In the electromagnetically driven devices of the present invention, acoustic feedback is significantly reduced because the tympanic membrane is directly vibrated. This direct vibration ultimately results in generation of sound in the ear canal because the tympanic membrane acts as a loudspeaker cone. However, the level of generated acoustic energy is significantly less than in conventional hearing aids that generate direct acoustic energy in the ear canal. This results in much greater functional gain for the open ear canal electromagnetic transmitter and transducer than with conventional acoustic hearing aids.

Because the input transducer (e.g., microphone) is positioned in the ear canal, the microphone is able to receive and retransmit the high-frequency three dimensional spatial cues. If the microphone was not positioned within the auditory ear canal, (for example, if the microphone is placed behind-the ear (BTE)), then the signal reaching its microphone does not carry the spatially dependent pinna cues. Thus there is little chance for there to be spatial information.

Figure 4B:
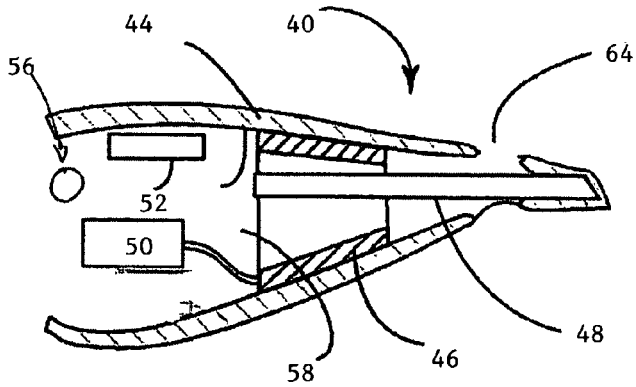
FIG. 4B illustrates an alternative embodiment of the hearing system of the present invention with the coil laid along an inner wall of the shell.

FIG. 4B illustrates an alternative embodiment of a transmitter assembly 42 wherein the microphone 56 is positioned near the opening of the ear canal on shell 44 and the coil 46 is laid on the inner walls of the shell 44. The core 62 is positioned within the inner diameter of the coil 46 and may be attached to either the shell 44 or the coil 46. In this embodiment, ambient sound may still enter ear canal and pass through the open chamber 58 and out the ports 68 to directly vibrate the tympanic membrane 16.

Figure 6A:
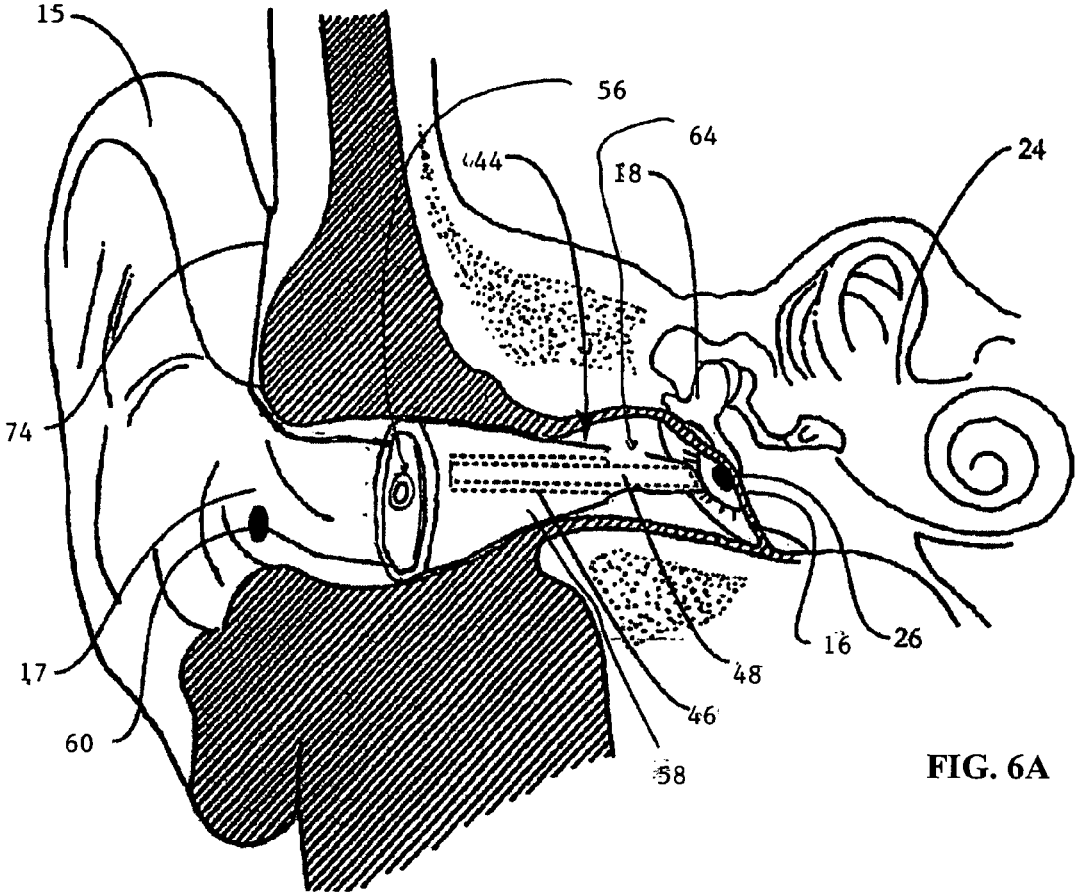
FIG. 6A illustrates a hearing system embodiment having a microphone (input transducer) positioned on an inner surface of a canal shell and a transmitter assembly positioned in an ear canal that is in communication with the transducer that is coupled to the tympanic membrane.
Figure 6B:
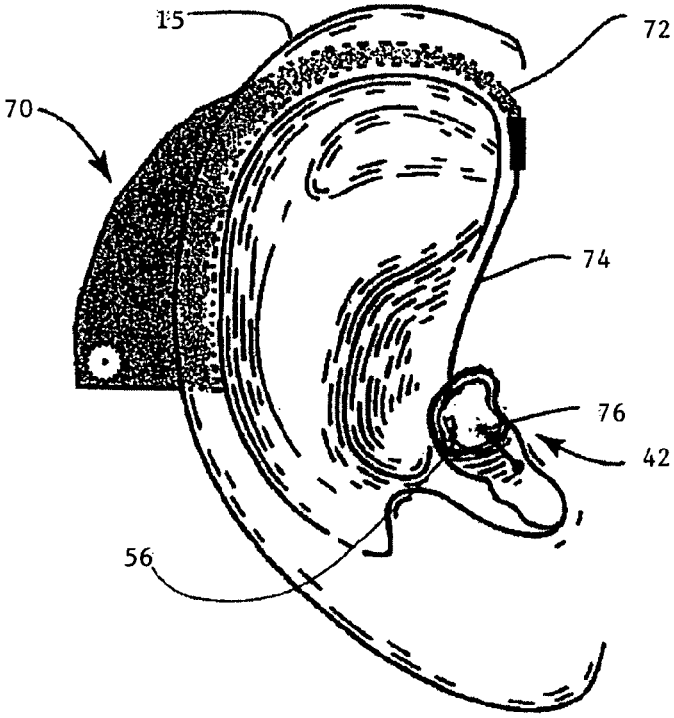
FIG. 6B illustrates an alternative medial view of the present invention with a microphone in the canal shell wall near the entrance.

Now referring to FIGS. 6A and 6B, an alternative embodiment is illustrated wherein one or more of the DSP unit 50 and battery 52 are located external to the auditory ear canal in a driver unit 70. Driver unit 70 may hook on to the top end of the pinna 15 via ear hook 72. This configuration provides additional clearance for the open chamber 58 of shell 44 (FIG. 4B), and also allows for inclusion of components that would not otherwise fit in the ear canal of the individual. In such embodiments, it is still preferable to have the microphone 56 located in or at the opening of the ear canal 17 to gain benefit of high bandwidth spatial localization cues from the auricle 17. As shown in FIGS. 6A and 6B, sound entering the ear canal 17 is captured by microphone 56. The signal is then sent to the DSP unit 50 located in the driver unit 70 for processing via an input wire in cable 74 connected to jack 76 in shell 44. Once the signal is processed by the DSP unit 50, the signal is delivered to the coil 46 by an output wire passing back through cable 74.

Figure 7:
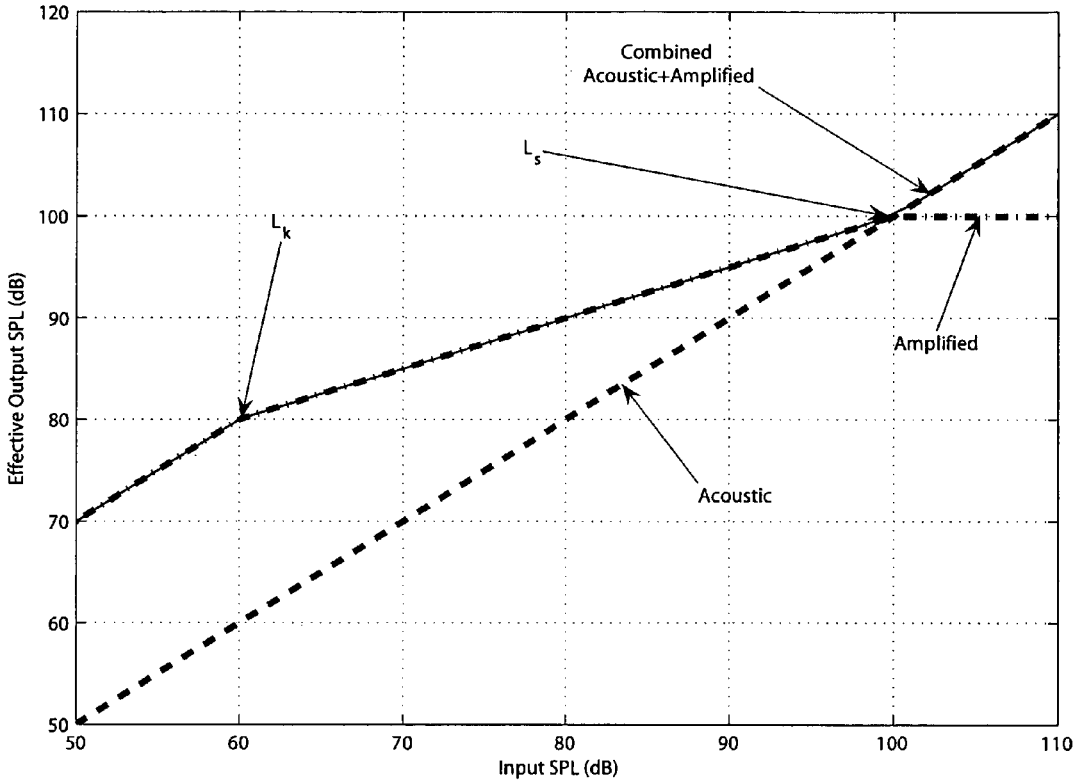
FIG. 7 is a graph that illustrates an acoustic signal that reaches the ear drum and the effective amplified signal at the eardrum and the combined effect of the two.

FIG. 7 is a graph that illustrates the effective output sound pressure level (SPL) versus the input sound pressure level. As shown in the graph, since the hearing systems 40 of the present invention provide an open auditory ear canal 17, ambient sound is able to be directly transmitted through the auditory ear canal and directly onto the tympanic membrane 17. As shown in the graph, the line labeled "acoustic" shows the acoustic signal that directly reaches the tympanic membrane through the open ear canal. The line labeled "amplified" illustrates the signal that is directed to the tympanic membrane through the hearing system of the present invention. Below the input knee level $L_k$, the output increases linearly. Above input saturation level $L_s$, the amplified output signal is limited and no longer increases with increasing input level. Between input levels $L_k$ and $L_s$, the output maybe be compressed, as shown. The line labeled "Combined Acoustic+Amplified" illustrates the combined effect of both the acoustic signal and the amplified signal. Note that despite the fact that the output of the amplified system is saturated above $L_s$, the combined effect is that effective sound input continues to increase due to the acoustic input from the open canal.

The foregoing description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

What is claimed is:

1. A hearing system comprising:

a shell having an outer surface and an open inner chamber, said outer surface configured to conform to an inner wall surface of the ear canal;

an input transducer disposed inside of the shell, wherein said input transducer captures ambient sound, including high frequency spatial localization cues, that enters the ear canal of the user and converts the captured sound into electrical signals; and a transmitter assembly that receives the electrical signals from the input transducer, the transmitter assembly comprising a signal processor that has a frequency response bandwidth in a 6.0 kHz to 20 kHz range, the transmitter assembly configured to deliver filtered signals to an output transducer positioned in a middle or inner ear of the user, the filtered signals being representative of the ambient sound received by the input transducer, wherein openings in the shell allow ambient sound to pass through the open chamber and bypass the input transducer to directly reach the middle ear of the user; and wherein the open chamber of the shell houses at least a portion of the transmitter assembly, and the shell comprises a first end that is configured to be positioned adjacent to an entrance of the ear canal and a second end that is configured to be positioned in proximity to the tympanic membrane, wherein the second end comprises one or more of said openings that allow the ambient sound from outside the entrance of the ear canal to directly reach the middle or inner ear of the user.

2. The hearing system of claim 1 wherein the frequency response bandwidth allows for delivery of high-frequency localization cues in a 7 kHz to 13 kHz range to the middle ear of the user.

3. The hearing system of claim 1, wherein the input transducer is positioned at a first end of the shell.

4. The hearing system of claim 1 wherein the transmitter assembly comprises an acoustic transmitter.

5. The hearing system of claim 1 wherein the transmitter assembly comprises a fluid pressure transmitter.

6. The hearing system of claim 1, wherein the transmitter assembly comprises an optical transmitter.

7. The hearing system of claim 1 wherein the transmitter assembly comprises an electromagnetic transmitter and transmission element that receive a signal from the signal processor, the electromagnetic transmitter delivering the filtered signals to the output transducer through the transmission element.

8. The hearing system of claim 7 wherein the signal processor, electromagnetic transmitter and transmission element are disposed within the ear canal of the user.

9. The hearing system of claim 7 wherein the signal processor is located behind a pinna of the user and the electromagnetic transmitter and transmission element are disposed within the ear canal of the user.

10. The hearing system of claim 7 the output transducer is coupled to an acoustic member of the middle ear, the transducer being configured to receive the filtered signals from the transmission element.

11. The hearing system of claim 10 wherein the transducer comprises a permanent magnet.

12. The hearing system of claim 10 wherein the filtered signals are in the form of a modulated electromagnetic field.

13. The hearing system of claim 12 wherein the transducer is coupled to a tympanic membrane of the user.

14. The hearing system of claim 13 wherein the transducer is embedded in a conically shaped film that is configured to releasably contact a surface of the tympanic membrane.

15. A method comprising:

positioning a shell within an open ear canal of a user to capture ambient sound,said shell having an outer surface which conforms to an inner wall of the ear canal;

transmitting signals that are indicative of the ambient sound received by an input transducer within an open chamber of the shell to a transmitter assembly;

filtering the signals at the transmitter assembly with a signal processor that has bandwidth that is above about 6.0 kHz; and delivering filtered signals to a middle ear or inner ear of the user;

wherein the open chamber inside the shell allows non-filtered ambient sound to bypass the input transducer and directly reach the middle ear of the user; and wherein the open chamber of the shell houses at least a portion of the transmitter assembly, and the shell comprises a first end that is configured to be positioned adjacent to an entrance of the ear canal and a second end that is configured to be positioned in proximity to the tympanic membrane, wherein the second end comprises one or more of said openings that allow the ambient sound from outside the entrance of the ear canal to directly reach the middle or inner ear of the user.

16. The method of claim 15 wherein the signal processor has a bandwidth between about 6 kHz and about 20 kHz.

17. The method of claim 15 wherein the filtered signals comprise high-frequency spatial localization cues.

18. The method of claim 15 comprising positioning the signal processor, electromagnetic transmitter, and the transmission element in the ear canal.

19. The method of claim 15 wherein the positioning of the input transducer and transmitter assembly reduces feedback and provides an improved signal to noise ratio of up to about 8 dB.

20. The method of claim 15 wherein a transmitter assembly comprising an electromagnetic transmitter and a transmission element in communication with a signal processor is disposed with the shell, wherein delivering filtered signals to the middle ear of the user comprises:

directing signals from the signal processor to the electromagnetic transmitter;

delivering filtered electromagnetic signals from the electromagnetic transmitter to the middle ear through the transmission element.

21. The method of claim 20 comprising coupling a transducer to a tympanic membrane of the user, wherein delivering filtered electromagnetic signals from the electromagnetic transmitter to the middle ear through the transmission element is carried out by delivering the filtered electromagnetic signals to the transducer which is mechanically vibrated according to the filtered electromagnetic signals.

22. The method of claim 20 comprising positioning the electromagnetic transmitter and the transmission element in the ear canal and positioning the signal processor outside of the ear canal.

23. The method of claim 20 wherein delivering filtered signals comprises delivering filtered optical signals.

24. The method of claim 20 wherein delivering filtered signals comprises delivering filtered acoustic signals.

* * * * *